US005979683A

United States Patent [19]

Kobayashi et al.

[11] Patent Number: 5,979,683

[45] Date of Patent: Nov. 9, 1999

[54] MOULDED CAP WITH A GASKET

[75] Inventors: Fujio Kobayashi; Minoru Yonekawa, both of Hachioji, Japan

[73] Assignee: Kioritz Corporation, Tokyo, Japan

[21] Appl. No.: 08/882,068

[22] Filed: Jun. 25, 1997

[30] Foreign Application Priority Data

Jun. 25, 1996 [JP] Japan ..... 8-163981

[51] Int. Cl.[6] ..... B65D 53/00

[52] U.S. Cl. ..... 215/352; 215/350; 220/304

[58] Field of Search ..... 215/350, 352, 215/307; 220/303, 304, 378

[56] References Cited

U.S. PATENT DOCUMENTS

| | | | |
|---|---|---|---|
| 4,276,990 | 7/1981 | Chiodo | 220/209 |
| 4,457,325 | 7/1984 | Green . | |
| 4,629,083 | 12/1986 | Druitt . | |
| 5,833,088 | 11/1998 | Kladders et al. | 215/248 |
| 5,836,364 | 11/1998 | Burton | 215/307 X |

FOREIGN PATENT DOCUMENTS

| | | |
|---|---|---|
| 16 83 510 | 6/1954 | Germany . |
| 288 362 | 5/1953 | Switzerland . |

*Primary Examiner*—Stephen K. Cronin
*Attorney, Agent, or Firm*—Thelen, Reid & Priest, LLP

[57] ABSTRACT

A cap assembly for sealing a spout of a container, the cap assembly comprising:

a) a cap including:
1) a top wall formed with a plurality of vertical holes; and
2) a skirt that is suspended from the top wall so that the vertical holes in the top wall form respective shelves extending laterally near a boundary region between the top wall and the skirt; and b) a gasket that is mounted on an inner side of the top wall, the gasket having:
1) a body adapted to seal the spout of the container; and
2) a plurality of ears, the ears extending laterally outward from the body, spaced from each other along a circumference of the body, corresponding to the respective vertical holes in the top wall, and supported by the respective shelves.

6 Claims, 4 Drawing Sheets

MOULDED CAP WITH A GASKET

BACKGROUND OF THE INVENTION

The present invention relates to a cap for a container, and, more particularly, to a cap moulded with a material such as plastic or the like and having a gasket therein.

RELATED ART

A gasket is provided in a cap for sealing a container, especially for a container to be used for liquids such as liquid fuels to prevent leakage thereof. In general, the gasket is made of a rubber material. The rubber material expands or shrinks due to an effect of the fuel within the container. As a result, the gasket sometimes falls off from the cap when the cap is opened. If the cap is closed again without the gasket, it causes the leakage of the fuel.

Conventionally, as means to prevent falling of the gasket, an undercut is formed inside the cap to receive a circumferential portion of the gasket for securing the gasket thereto as shown in, for example, U.S. Pat. No. 4,457,325. However, the cap is usually manufactured by an injection moulding process. Therefore, to form the undercut inside the cap, the cap must be machined by a separate machining process after the cap is moulded, or a specially designed mould, for example, a collapsible core or the like, which facilitates removal of the moulded cap from the mould must be utilized.

Forming the undercut by the separate process causes manufacturing efficiency to go down and manufacturing cost to increase. Further, to form the undercut as a part of the moulding process of the cap, the structure of the mould becomes complicated which results in an increase in its cost. Furthermore, it is time consuming to remove the moulded cap from the mould. It also causes the efficiency of moulding cycles to go down.

SUMMARY OF THE INVENTION

It is, therefore, an object of the present invention to provide a cap with a gasket for sealing a container which can be moulded efficiently and at a low cost.

The inventors of the present invention realized that the cause for requiring the separate machining process or the complex mould is due to the fact that the undercut for securing the gasket is extending in a direction perpendicular to a direction of removing the mould. Therefore, in the present invention, the undercut is made by forming a vertical hole in the top wall of the cap which extends in the same direction as that of removing the mold or ejecting the moulded cap. The mould for forming the outer shape of the cap is provided with a plurality of protrusions, each having a complementary shape with the vertical hole. The protrusion extends straight in the same direction as that of removing the mould or ejecting the moulded cap. Therefore, the present invention enables to remove the cap to be removed from the mould by simply translating the mould in a straight motion or by ejecting the moulded cap.

The above and other objects of the present invention can be accomplished by a cap assembly for sealing a spout of a container, the cap assembly comprising: a) a cap including: 1) a top wall formed with a plurality of vertical holes; and 2) a skirt that is suspended from the top wall so that the vertical holes in the top wall form respective shelves extending laterally near a boundary region between the top wall and the skirt; and b) a gasket that is mounted on an inner side of the top wall, the gasket having: 1) a body adapted to seal the spout of the container; and 2) a plurality of ears, the ears extending laterally outward from the body, spaced from each other along a circumference of the body, corresponding to the respective vertical holes in the top wall, and supported by the respective shelves.

The cap according to the present invention can be integrally formed with a simple mould provided with a plurality of protrusions on the mould for forming an outer shape of the cap. Each protrusion is formed in a complementary shape with the shape of the vertical hole. Since the protrusion extends straight in a vertical direction, the cap having an undercut can be removed from the mould by simply translating the mould straight in the vertical direction or ejecting the moulded cap in the vertical direction. When the gasket is mounted on the moulded cap, the ears thereof are supported on the shelves formed in the skirt near the boundary region between the top wall and the skirt of the cap. The ears are held on the shelves by the self-sustaining shape of the gasket or friction between the surfaces of the ears and the shelves, whereby falling of the gasket is prevented. Further, since the ears can be observed through the vertical holes from outside, the presence of the gasket and whether the spout is sealed or not can be checked by looking into the vertical holes without actually removing the cap from the spout.

In a preferred aspect of the present invention, circumferential dimensions of the holes are substantially the same as respective circumferential dimensions of the ears.

In a further preferred aspect of the present invention, a vertical distance between a lower surface of the top wall and the shelves is substantially the same as a thickness of the ears.

In a still further preferred aspect of the present invention, slopes, extending from respective vertical holes and inclined downward in a radially outward direction, are formed on an edge between the top wall and the skirt.

The above and other objects and features of the present invention will become apparent from the following description made with reference to the accompanying drawings.

DESCRIPTION OF THE PREFERRED EMBODIMENTS

Figure 1:
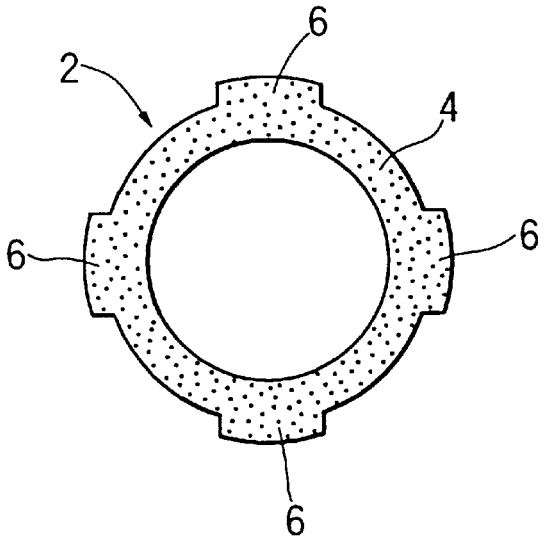
FIG. 1 is a plan view of a gasket to be mounted on a cap according to the present invention.

As illustrated in FIG. 1, a gasket 2 comprises an annular body 4 for sealing a circular spout 1*a* (FIG. 3) of a container 1 and four ears 6 extending radially outward from the body 4 and equally spaced from each other along a circumference of the body 4. The gasket 2 is made of a resilient material, such as synthetic rubber or the like, having a characteristic of self-sustainability of its shape, which ensures sealing of the spout 1*a* of the container 1 and facilitates mounting thereof inside a cap.

Figure 2:
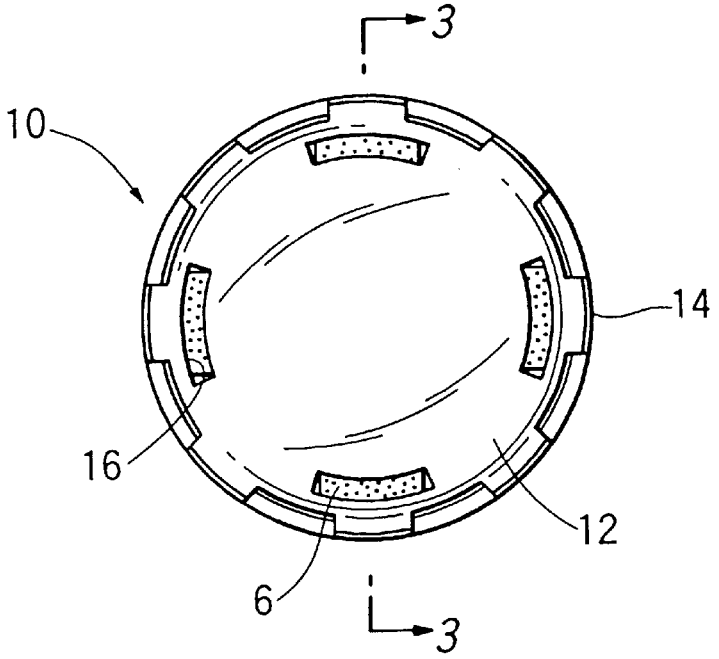
FIG. 2 is a plan view of a moulded cap according to a first embodiment of the present invention.
Figure 3A:
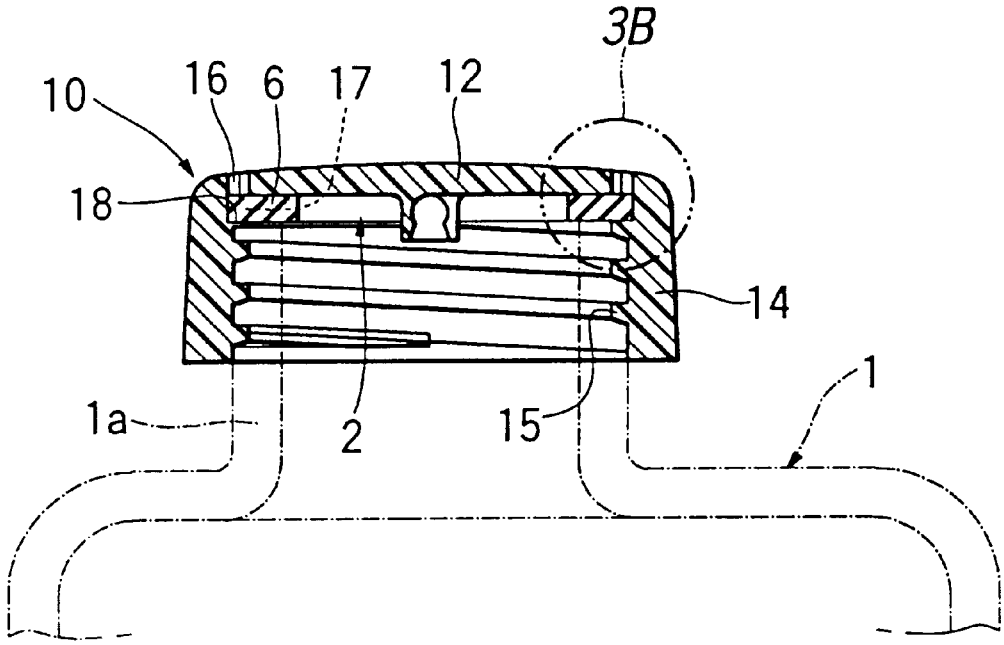
FIGS. 3A and 3B are a cross-sectional view taken along the line 3—3 shown in FIG. 2.

As shown in FIGS. 2 and 3A, a cap 10 has a top wall 12 and a skirt 14 suspended therefrom, both of which are integrally moulded with a material such as plastic. An inner surface of the skirt 14 is formed with female threads 15 to be engaged with male threads of the spout 1*a* of the container 1.

Figure 3B:
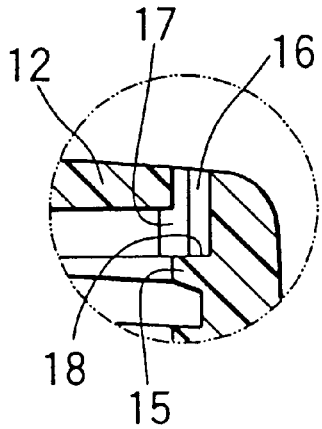

Vertical openings 16 which extend straight in a vertical direction from an upper surface of the top wall 12 are formed therein by a moulding process. The number of vertical holes 16 is as same as the number of ears 6 of the gasket 2, preferably, four. As shown in FIG. 3, each of the vertical holes 16 communicates with an inner space of the cap 10 through the wall of the skirt 14 near a boundary region between the skirt 14 and the top wall 12. The vertical holes 16 define four pockets 17 for receiving the ears 6, each having an opening oriented radially inward in a horizontal direction. The ear 6 of the gasket 2 is inserted into the pocket 17 from the inner side of the cap 10 and is supported by a bottom surface of the pocket 17 which defines a horizontal shelf 18. The vertical hole 16 has dimensions in a circumferential and radial directions substantially the same as those of the ear 6. Further, the vertical distance between the lower surface of the top wall 12 and the horizontal shelf 18 is substantially the same as a thickness of the gasket 2.

To mount the gasket 2 on the inner side of the top wall 12, the ears 6 of the gasket 2 are bent and the gasket 2 is placed in the inner space of the cap 10. Then, each ear 6 is inserted into each pocket 17 which is in communication with the inner space of the cap 10 whereby the ears 6 are supported on the shelves 18. The ear 6 is fitted into the pocket 17 having substantially the same size as that of the ear 6 as viewed in the plan view of FIG. 2.

Figure 4:
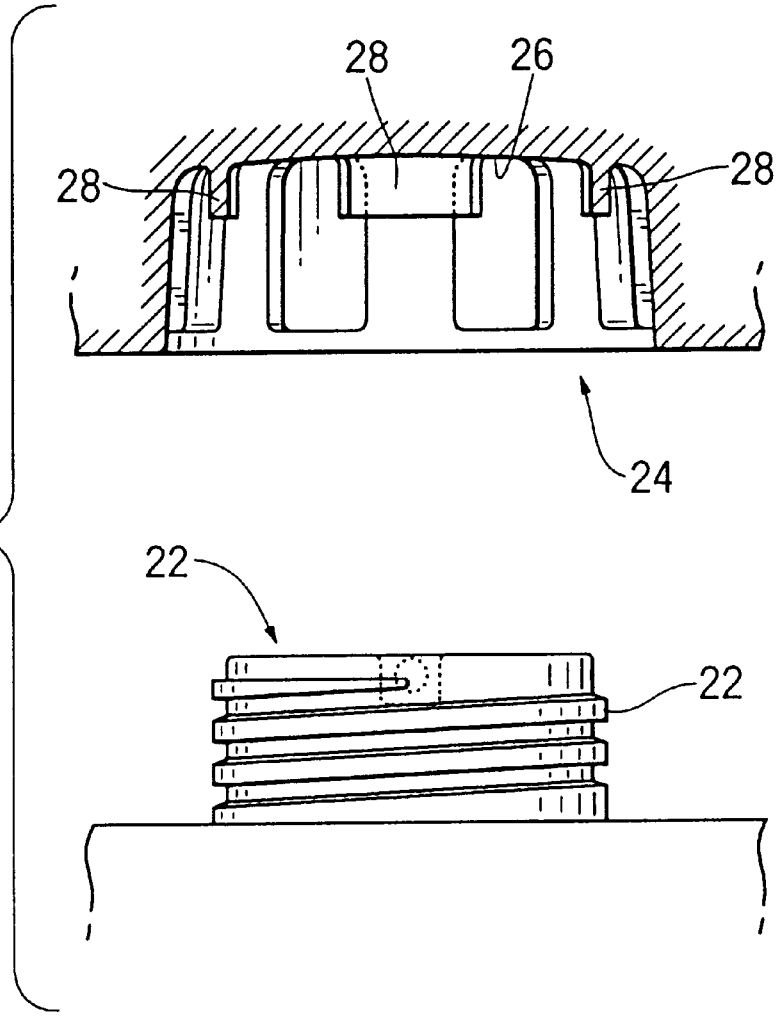
FIG. 4 shows an example of a mould for moulding the cap shown in FIGS. 2 and 3A.

FIG. 4 shows an example of a mould for moulding the cap 10 by an injection moulding process. In FIG. 4, a side view of a first mould half 20 for forming an inner shape of the cap 10 and a cross-sectional view of a second mould half 24 for forming an outer shape of the cap 10 are shown.

As illustrated in FIG. 4, male threads 22 for forming the female threads 15 on the inner surface of the skirt 14 are formed on an outer surface of the first mould half 20. Further, four protrusions 28 are suspended from the lower surface 26 of the second mould half 24. Each protrusion 28 has a shape that is complementary with the vertical hole 16 and is for forming the vertical hole 16 in the top wall 12 of the cap 10. After the cap 10 is moulded, the first mould half 20 is unscrewed to remove it from the cap 10. Then, the cap 10 is pushed vertically downward by a stick (not shown) to eject it from the second mould half 24.

Figure 5:
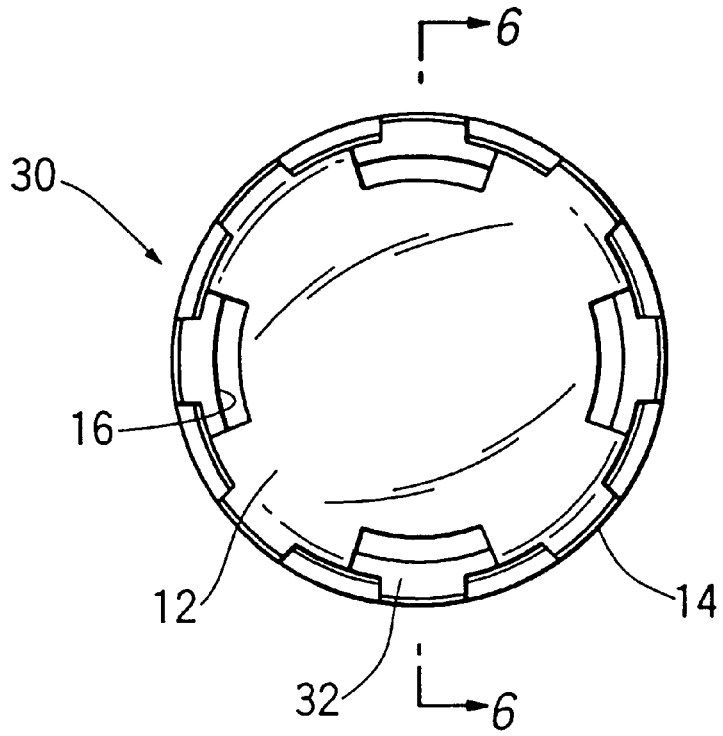
FIG. 5 is a plan view of a cap according to a second embodiment of the present invention.
Figure 6:
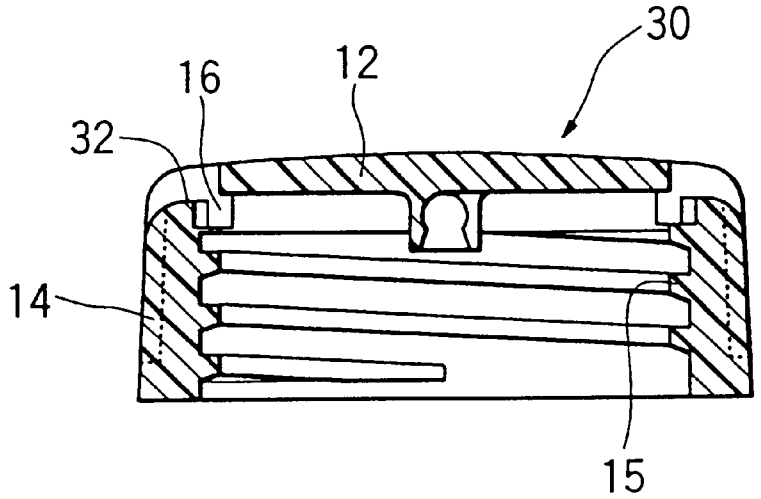
FIG. 6 is a cross-sectional view taken along the line 6—6 shown in FIG. 5.

FIG. 5 is a plan view of a cap 30 according to a second embodiment of the present invention and FIG. 6 is a cross-sectional view taken along the line 6—6 shown in FIG. 5. In FIGS. 5 and 6, the same elements as those in FIGS. 2 and 3 are indicated by the same numerals. As shown in FIG. 5, a slope 32 extending radially outward and inclining downward is formed at an outer edge between the top wall 12 and the skirt 14 of the cap 30. The gasket 2 shown in FIG. 1 can be mounted on the cap 30 in the same manner as explained above.

According to the embodiment of the present invention, an undercut is formed by forming a vertical hole 16 in the top wall 12 of the cap 10, 30 by a protrusion of the mould extending in the same direction as the direction in which the mould is removed or the cap 10, 30 is ejected. It enables the cap to be removed from the mould by simply moving the mould in a straight motion or ejecting the cap.

Further, since the ears 6 can be observed through the vertical holes 16 from outside, the presence of the gasket 2 in the cap 10, 30 and whether the spout of the container is sealed or not can be checked by looking into the vertical holes 16 without actually removing the cap 10, 30 from the spout 1*a*.

Since the circumferential dimension of the vertical hole 16 is substantially the same as that of the ear 6, the turning of the gasket about a center axis of the cap is prevented when the cap is screwed onto the spout of the container. It prevents the edge of the gasket from curling.

Further, since a vertical distance between a lower surface of the top wall and the shelf is substantially the same as a thickness of the ear 6, the opening in communication with the inner space of the cap 10, 30 can be sealingly closed by the ear. Therefore, it prevents any foreign objects such as dirt from entering into the inner space of the cap through the vertical hole when the cap is removed.

Furthermore, since the slope extending from the vertical hole and inclined downward in a radially outward direction is formed at the edge between the top wall and the skirt, foreign objects such as dirt entered into the vertical hole can be led outside. Therefore, the foreign objects do not accumulate therein.

The present invention has thus been shown and described with reference to specific embodiments. However, it should be noted that the present invention is in no way limited to the details of the described arrangements but changes and modifications may be made without departing from the scope of the appended claims.

For example, although the shelf 18 in the first and second embodiments extends horizontally, it may extend laterally so long as to adequately hold the ear 6 of the gasket 2 in position. For example, the shelf 18 may be inclined downward in a radially outward direction. The ear 6 of the gasket 2 may be formed with an angle with respect to the body thereof to conform to the shape of the shelf 18. It enables the ear 6 to hook on the shelf 18 to prevent the falling of the gasket 2.

Furthermore, in the first and second preferred embodiments of the present invention, a side surface of the vertical hole 16 extends straight in the vertical direction. The side surface may be shaped in another shape which allows the mould to be removed by simply moving the mold in a vertical direction or ejecting the moulded cap in the vertical direction. Therefore, it can be inclined so that the cross sectional area of the vertical hole 16 converges in a downward direction to facilitate removal of the mould.

In the first and second preferred embodiments of the present invention, the circumferential and radial dimensions of the vertical hole 16 are substantially the same as those of the ear 6. However, the dimensions thereof can be determined as needed taking expansion and shrinkage of the gasket into consideration.

Furthermore, the gasket 2 shown in FIG. 1 is mounted on the cap 30 in the second embodiment of the present invention as set forth above. However, the ear 6 of the gasket 2 may be formed with steps along the edge of the ear 6 so that it can be hooked on the slope 32. It assures to prevent the gasket 2 from falling.

The present invention provides a cap with a gasket for sealing a container which can be moulded efficiently and at low cost.

We claim:

1. A cap assembly for sealing a spout of a container, the cap assembly comprising:

a) a cap including:

1) a top wall formed with a plurality of vertical holes; and 2) a skirt that is suspended from the top wall so that the vertical holes in the top wall form respective shelves extending laterally near a boundary region between the top wall and the skirt; and b) a gasket that is mounted on an inner side of the top wall, the gasket having:

1) a body adapted to seal the spout of the container; and 2) a plurality of ears, the ears extending laterally outward from the body, spaced from each other along a circumference of the body, corresponding to the respective vertical holes in the top wall, and supported by the respective shelves.

2. The cap assembly of claim 1, wherein:

slopes, extending from respective vertical holes and inclined downward in a radially outward direction, are formed on an edge between the top wall and the skirt.

3. The cap assembly of claim 1, wherein:

circumferential dimensions of the holes are substantially the same as respective circumferential dimensions of the ears.

4. The cap assembly of claim 3, wherein:

slopes, extending from respective vertical holes and inclined downward in a radially outward direction, are formed on an edge between the top wall and the skirt.

5. The cap assembly of claim 1, wherein:

a vertical distance between a lower surface of the top wall and the shelves is substantially the same as a thickness of the ears.

6. The cap assembly of claim 5, wherein:

slopes, extending from respective vertical holes and inclined downward in a radially outward direction, are formed on an edge between the top wall and the skirt.

* * * * *